US012618311B2

(12) United States Patent
Szutiak et al.

(10) Patent No.: US 12,618,311 B2
(45) Date of Patent: May 5, 2026

(54) METHODS AND SYSTEMS FOR INSTALLING TUBULARS IN WELLS

(71) Applicant: GreenFire Energy Inc., Walnut Creek, CA (US)

(72) Inventors: Greg Szutiak, Calgary (CA); John R. Muir, St. George, UT (US); Alan D. Eastman, Holladay, UT (US); Joseph A. Scherer, Oakland, CA (US)

(73) Assignee: GreenFire Energy Inc., Walnut Creek, CA (US)

( * ) Notice: Subject to any disclaimer, the term of this patent is extended or adjusted under 35 U.S.C. 154(b) by 0 days.

(21) Appl. No.: 18/941,974

(22) Filed: Nov. 8, 2024

(65) Prior Publication Data

US 2025/0146387 A1 May 8, 2025

Related U.S. Application Data

(60) Provisional application No. 63/597,192, filed on Nov. 8, 2023.

(51) Int. Cl.
*E21B 43/10* (2006.01)

(52) U.S. Cl.
CPC ..... *E21B 43/10* (2013.01)

(58) Field of Classification Search
CPC ..... E21B 43/10
See application file for complete search history.

(56) References Cited

U.S. PATENT DOCUMENTS

| | | | | |
|---|---|---|---|---|
| 6,164,391 | A * | 12/2000 | Wurm | E21B 19/20 175/52 |
| 11,994,010 | B2 * | 5/2024 | Steele | F03G 4/00 |
| 2003/0221870 | A1 | 12/2003 | Johnson, Jr. | |
| 2012/0160518 | A1 * | 6/2012 | Sonnier | E21B 19/08 166/382 |
| 2018/0224029 | A1 * | 8/2018 | Ruehmann | G01L 5/24 |
| 2019/0106950 | A1 | 4/2019 | Alvaer et al. | |
| 2019/0119997 | A1 * | 4/2019 | Helms | G01L 5/24 |
| 2021/0062682 | A1 | 3/2021 | Higgins et al. | |
| 2022/0065045 | A1 | 3/2022 | Knolle | |

(Continued)

FOREIGN PATENT DOCUMENTS

| | | |
|---|---|---|
| EP | 3623723 B1 | 6/2023 |
| JP | 5533620 B2 | 6/2014 |

OTHER PUBLICATIONS

International Search Report and Written Opinion issued in Application No. PCT/US2024/055222, mailed on Feb. 4, 2025 (16 pages).

*Primary Examiner* — Taras P Bemko
(74) *Attorney, Agent, or Firm* — Osha Bergman Watanabe & Burton LLP

(57) ABSTRACT

A system may include a handling mast, a tubular source stack, a tubing loader, a spider device, and a connection device. The tubing loader is configured to capture a first HVT from the tubular source stack, load the first HVT into the handling mast, capture a second HVT from the tubular source stack, and load the second HVT into the handling mast. The spider device is configured to grasp the first HVT. The connection device is configured to align a proximal end of the first HVT and a distal end of the second HVT and couple the first HVT and the second HVT to form a tubing string. The handling mast is configured to insert the tubing string into the wellbore.

16 Claims, 7 Drawing Sheets

(56) References Cited

U.S. PATENT DOCUMENTS

| | | | | |
|---|---|---|---|---|
| 2023/0383999 | A1* | 11/2023 | Reitsma | F03G 4/074 |
| 2024/0228868 | A1* | 7/2024 | Werries | F24T 10/20 |
| 2024/0360741 | A1* | 10/2024 | Snijder Van Wissenkerke | E21B 41/0085 |

* cited by examiner

METHODS AND SYSTEMS FOR INSTALLING TUBULARS IN WELLS

BACKGROUND

In conventional drilling and completion, either a drilling rig or a completion rig would be used for inserting tubulars after a new well is drilled, or for inserting tubulars in an existing well. Both drilling and completion rigs are designed for use with standard steel pipes. Consequently, their equipment may be insufficiently precise and insufficiently gentle to assure that more-delicate high-value tubulars (HVT) are not damaged during insertion into the wellbore. This is especially significant at the joints in a tubing string, which are highly susceptible to assembly errors like cross-threading. In the geothermal context, not only can the joints leak well fluids, but the loss of the heat carried by those fluids can have a strong deleterious effect on well operation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some aspects, the techniques described herein relate to a system for installing high-value tubulars (HVT) in a wellbore. The system includes a specialized tubing insertion rig (STIR) configured to handle a plurality of HVT so as not to damage each of the plurality of HVT and insert the plurality of HVT in the wellbore. The STIR includes a handling mast, a tubular source stack, a tubing loader, a spider device, a connection device, and a control system. The tubular source stack is configured to store the plurality of HVT. The tubing loader is configured to capture a first HVT from the tubular source stack, load the first HVT into the handling mast, capture a second HVT from the tubular source stack, and load the second HVT into the handling mast. The handling mast is configured to insert a downhole heat exchanger and the first HVT into the wellbore. The spider device is configured to grasp the first HVT so that the first HVT is suspended at least partially within the wellbore by the spider device. The connection device is configured to align a proximal end of the first HVT and a distal end of the second HVT. The connection device is configured to couple a first portion of a fastening component of the proximal end of the first HVT and a second portion of the fastening component of the distal end of the second HVT to form a tubing string. The STIR is configured to insert the tubing string into the wellbore. The control system configured to: determine a number of rotations of the proximal end of the second HVT during coupling of each HVT; determine if a torque experienced between the proximal end of the first HVT and the distal end of the second HVT is greater than a preset torque threshold.

In some aspects, the techniques described herein relate to a method for installing high-value tubulars (HVT) in a wellbore penetrating a source formation. The method includes placing a specialized tubing insertion rig (STIR) at a well site including the wellbore. The STIR is configured to handle a plurality of HVT so as not to damage each of the plurality of HVT and insert the plurality of HVT in the wellbore. The plurality of HVT includes a first HVT and a second HVT. The method includes capturing, using a tubing loader, the first HVT from a tubular source stack. Each of the plurality of HVT includes a distal end and a proximal end. Each distal end includes a first portion of a fastening component and each proximal end includes a second portion of the fastening component. The method includes loading, using the tubing loader, the first HVT into a handling mast. The method includes disposing a downhole heat exchanger on the distal end of the first HVT. The method includes inserting, using the handling mast, the downhole heat exchanger and the first HVT into the wellbore. The first HVT is inserted with the distal end inserted first and is inserted until the proximal end is positioned adjacent to a spider device configured to grasp each HVT. The method includes grasping, using the spider device, the first HVT so that the first HVT is supported at least partially within the wellbore by the spider device. The method includes capturing, using the tubing loader, the second HVT from the tubular source stack. The method includes loading, using the tubing loader, the second HVT into the handling mast. The method includes aligning, using a connection device, the proximal end of the first HVT and the distal end of the second HVT. The method includes coupling, using the connection device, the first portion of the fastening component of the proximal end of the first HVT and the second portion of the fastening component of the distal end of the second HVT to form a tubing string. The method includes determining a number of rotations of the proximal end of the second HVT during coupling of each HVT. The method includes determining if a torque experienced between the proximal end of the first HVT and the distal end of the second HVT is greater than a preset torque threshold. The method includes inserting, using the handling mast, the tubing string into the wellbore if the torque is not greater than the preset torque threshold. The tubing string is operatively connected to a heat utilization facility.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
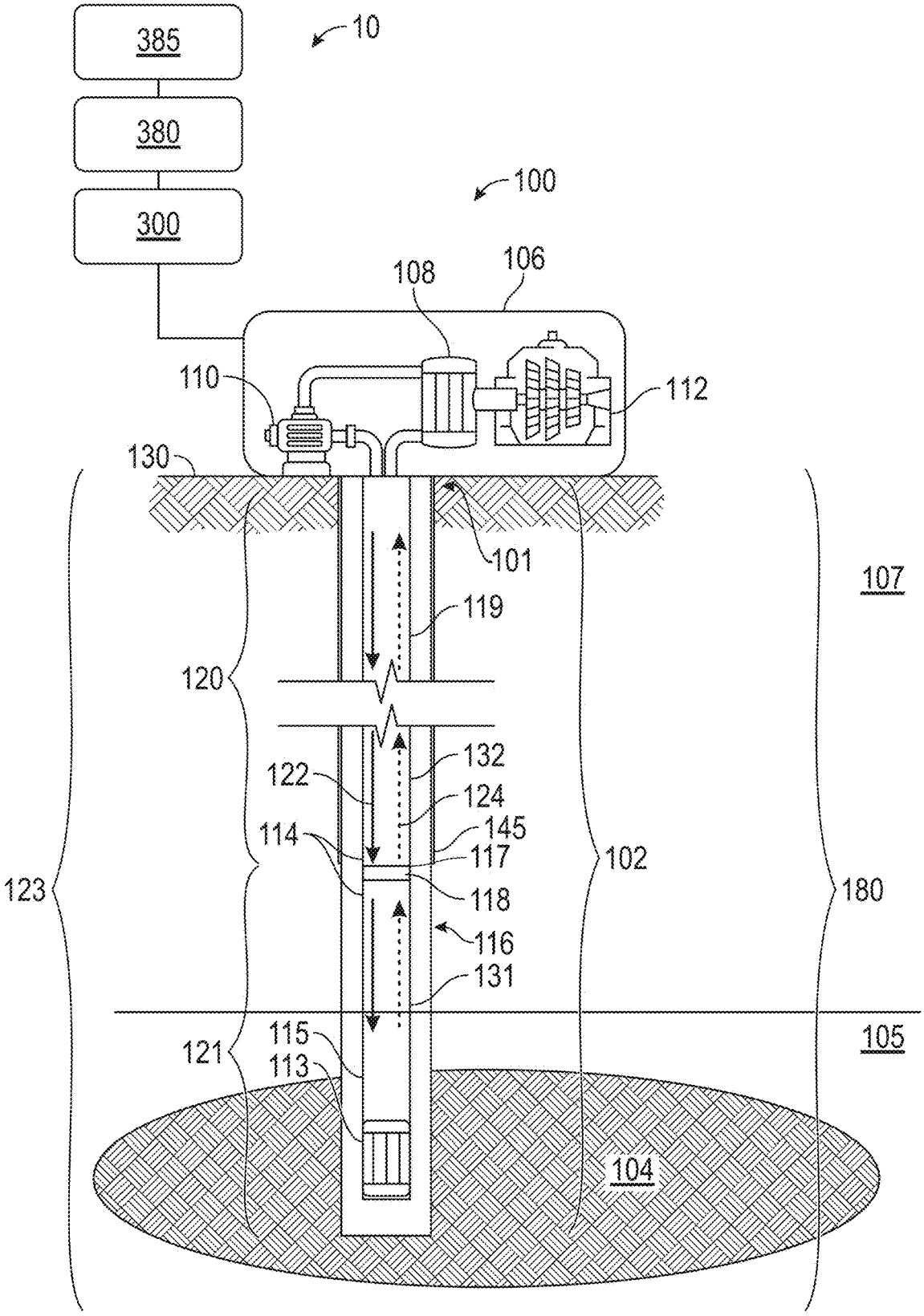
FIG. 1 depicts a geothermal system and a tubing insertion system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-6B, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Methods and systems for installing tubulars at a wellsite are disclosed herein. The tubular installation system may include a specialized tubing insertion rig (STIR) configured to insert tubulars of a heat exchange system into a wellbore. The STIR may be a streamlined rig with several typical systems for drilling and installing casing not included in the STIR. The STIR may also be configured to handle high-value tubulars that require gentler handling than typical tubulars. The STIR may also be configured to handle longer tubulars than are typical from conventional rigs. The STIR may be configured to insert tubulars at a pre-existing well or at a newly drilled well. The STIR may be configured to be set-up and taken down at a faster rate relative to conventional rigs. The system may be configured to capture a tubular and load the tubular into a handling mast of the STIR, dispose a downhole heat exchanger on a tubular, and insert the downhole heat exchanger and the tubular into the wellbore. The system may be configured to grasp each tubular so that the tubular is suspended at least partially within the well by a spider device configured to grasp a tubular. The system is configured to capture another tubular and load the tubular into the handling mast of the STIR, align each of the tubulars, and couple each tubular to form a tubing string. The STIR is configured to insert the tubing string into the wellbore.

The resulting heat exchange system installed into the wellbore using the STIR may thus be configured to produce heat from the formation. Due to the specialized handling provided by the STIR, the installed heat exchange system and associated piping is better adapted to produce the heat with less errors encountered with "typical" tubing systems associated with multi-purpose drilling and completion rigs.

FIG. 1 depicts a system for installing tubulars in a wellbore penetrating a source formation (hereafter "tubing insertion system" (10)) according to embodiments herein. The tubing insertion system (10), according to embodiments herein, may be used to install a heat exchange system (100) (e.g., a closed-loop geothermal system) depicted in FIG. 1 at a well site (101) within a geothermal system (180) having a heat source (104) (e.g., a geothermal heat source). The heat exchange system (100) includes a wellbore (102) running from the surface of the earth (130) to the heat source (104) in the subsurface. Typically, the heat source (104) will be a rock formation characterized by an elevated temperature (hereafter "source formation" (105)) and may lie at a depth of several thousand feet below the surface of the earth (130). Often the source formation (105) may be a volcanic pluton, solidified from molten lava injected by volcanic or tectonic forces between the surrounding formations, and have a low fluid permeability. The source formation (105) may be located under one or more additional rock formations (hereafter "overburden" (107)) within a subterranean region of interest (123) (i.e., a subsurface). The wellbore (102) may be substantially vertical, as shown, or may be significantly deviated. The wellbore (102) may also have horizontal portions, or even have portions that become shallower with increasing distance along the wellbore (102). In some embodiments, the wellbore (102) may be drilled for the purposes of creating the closed-loop geothermal system. However, in other embodiments the wellbore (102) may have been created for another purpose, such as, without limitation, a water well, a geotechnical well, an open-loop geothermal system, or a hydrocarbon well, and subsequently repurposed to become the wellbore (102) of the closed-loop geothermal system.

Portions of the wellbore may be cased, typically with a steel pipe, to form a cased hole (120). Typically, at least the shallowest portions of the wellbore may include casing (145) configured to provide mechanical stability to the wellbore (102) and/or to isolate near surface ground water, including drinking water aquifers, from fluid originating at deeper depths and/or the drilling fluids used to create the wellbore (102). Often the casing (145) will be cemented into place, using an annular sheath of cement between the exterior surface of the casing (145) and the rock wall of the wellbore (102). In some cases, multiple sets ("strings" (not shown)) of casing may be disposed within one another and substantially sharing a common axis. Other portions of the wellbore (102) may be left uncased to create "openhole" portions (121) of the wellbore (102). While the casing (145) essentially isolates the interior of the cased hole (120) from the fluids in the surrounding rock formations (e.g., the overburden (107) and/or the source formation (105)) and provides additional thermal insulation in the form of one or more layers of steel and cement, openhole portions (121) permit fluid, including hot fluid, and heat to flow more easily into and out of the openhole portion (121).

At, near, or above the surface of the earth (130) the wellbore (102) may connect to a heat utilization facility (106). The heat utilization facility (106) may include, without limitation, one or more heat exchangers, such as an uphole heat exchanger (108) to extract heat energy from the hot working fluid (124), and/or one or more uphole turbines, such as uphole turbine (112) to generate electrical power. The uphole turbine(s) may be operatively connected to the uphole heat exchanger(s) or operatively connected directly to the tubulars carrying the hot working fluid (124) uphole.

In accordance with one or more embodiments, a downhole heat exchanger (113) may be deployed at, or near, the bottom of the wellbore (102). The downhole heat exchanger (113) may function to heat cool working fluid (122) supplied to it by transferring heat from hot geothermal fluid surrounding the downhole heat exchanger (113) and producing hot working fluid (124). Tubulars may fluidically connect the downhole heat exchanger (113) with the heat utilization facility (106) on the surface of the earth (130), and particularly with the uphole heat exchanger (108), allowing cool working fluid (122) to flow, or to be pumped, for example by an uphole pump (110), downhole, and hot working fluid (124) to flow uphole. The tubulars may be configured to allow cool working fluid (122) to flow in one direction and hot working fluid (124) to flow in the opposite direction without mixing with one another. Examples of designs for tubulars may include, for example, a bidirectional fluid conduit shown and described below in FIGS. 2A-2D. Each tubular includes an outer portion. In some embodiments, the outer portion may be coated in protective coating and/or insulative materials such as vacuum-insulated tubulars ("VIT"). In some embodiments, the tubulars may be constructed of materials not typical of tubulars used in oil and gas wells, such as stainless steel, resin-based tubulars, and the like.

Embodiments that include tubulars either coated or constructed of non-typical materials (e.g., steel) may be termed as a "high-value tubular" ("HVT"). The tubing insertion system (10) may be used to dispose a plurality of HVT (114) and the downhole heat exchanger (113) in accordance with one or more embodiments. The plurality of HVT (114) includes a first HVT (131) and a second HVT (132). While not explicitly illustrated, the plurality of HVT may include additional HVT to extend the tubing string from the surface to the source formation. Each HVT (114) includes a distal end (115) and a proximal end (116). Each HVT (114) may be coupled, using a fastening component (118), to another one of the plurality of HVT (114) at a connection joint (117) to form a tubing string (119). Each distal end (115) may include a first portion of the fastening component (118), and each proximal end (116) may include a second portion of the fastening component (118). Each of the plurality of HVT (114) (e.g., the first HVT (131)) may be aligned, using a connection device, with the proximal end (116) of another one of the plurality of HVT (114) (e.g., the second HVT (132)). The first HVT (131) may be coupled, using the fastening component (118), to the second HVT (132) at the connection joint (117) of the two HVT.

In some embodiments of the tubular insertion systems and methods disclosed herein, a pre-existing wellbore may be used, such as the wellbore (102), for insertion of the plurality of HVT (114). For example, a wellbore previously drilled to provide fresh water, for geotechnical purposes, for open-loop geothermal purposes, or for hydrocarbon exploration may be used or extended for installation of the heat exchange system (100) using tubular insertion systems and methods according to embodiments herein. In other embodiments, the wellbore (102) may be drilled, using a wellbore drilling system, specifically for installation of the heat exchange system (100) having the plurality of HVT (114).

In some embodiments, the downhole heat exchanger (113) and the plurality of HVT (114) may be inserted into a wellbore such as the wellbore (102) using the tubular insertion system (10) having a specialized tubing insertion rig ("STIR") (300). The STIR (300) may be the same or similar to the STIR (300) as described in relation to FIG. 3. The STIR (300) may insert the tubing string (119) according to a well tubing plan (380) developed using a well tubing planning system (385) as described in relation to FIG. 3. The STIR (300) includes a power supply (301, FIG. 3). In some embodiments, the power supply (301) may be configured to use either electrical power to drive the systems of the STIR (300) distributed from a local power station or a local generator configured to use a fuel such as diesel fuel.

While FIG. 1 shows various configurations of components, other configurations may be used without departing from the scope of the disclosure. For example, various components in FIG. 1 may be combined to create a single component. As another example, the functionality performed by a single component may be performed by two or more components.

Figure 2A:
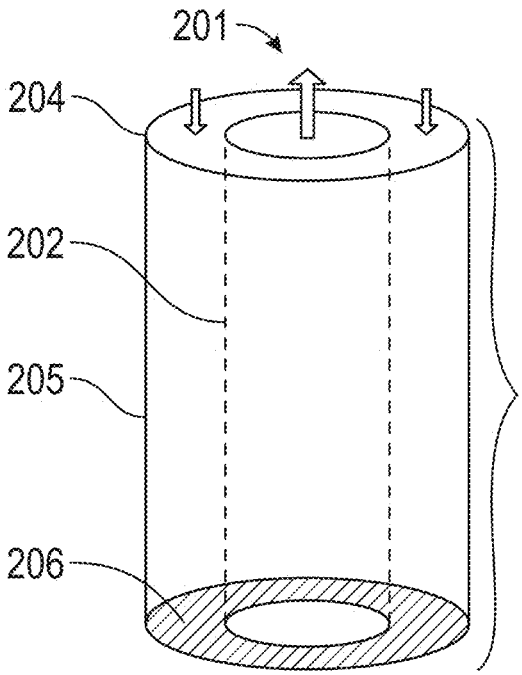
FIG. 2A-2D depict examples of bidirectional fluid conduit designs that may be used within a tubing insertion system in relation to various embodiments.

FIGS. 2A-2D depict examples of bidirectional fluid conduit designs that may be used in each of the plurality of HVT (114) in accordance with one or more embodiments. Each HVT includes an outer portion (205) and an axial length (203), which may be greater than a conventional tubular, used in oilfield operations, having a length of 30 feet (ft). For example, each HVT may be constructed having the axial length (203) between 31-60 ft. FIG. 2A shows a first design for a bidirectional fluid conduit (201). In FIG. 2A the bidirectional fluid conduit design includes two co-axial pipes with a first pipe (202) disposed within a second pipe (204). In some embodiments, the total cross-sectional area of the second pipe (204) may be essentially double the cross-sectional area of the first pipe (202), so that the cross-sectional area through which fluid can flow in one direction within the first pipe (202) is equal to the cross-sectional area of the annulus (206) through which fluid may flow in the reverse direction. For example, cool working fluid may flow in a first direction (downhole) in the first pipe (202) while hot working fluid may flow in the reverse direction (uphole) through the annulus, or vice versa.

Figure 2B:
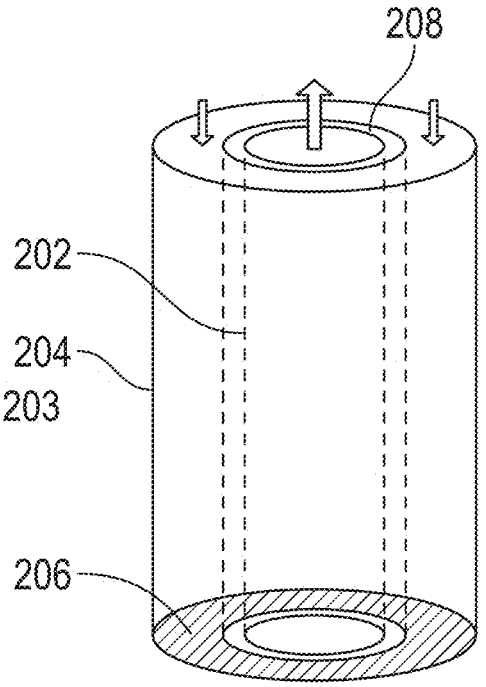

In some cases, it may be desirable to thermally isolate the two fluids from one another as much as is practical. Accordingly, as shown in FIG. 2B a thermally insulating layer or annulus (208) may be disposed between the first pipe (202) and the annulus (206). Alternatively, the thermal insulation may be created by constructing the first pipe from a material exhibiting low thermal conductivity.

Figure 2C:
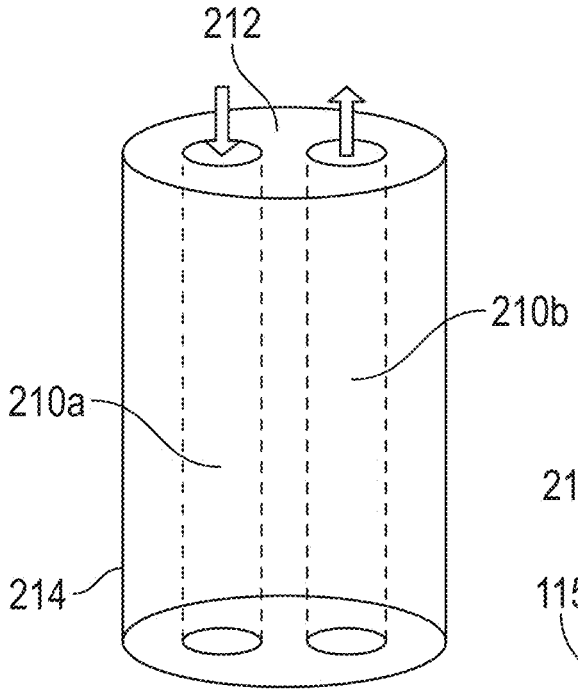
Figure 2D:
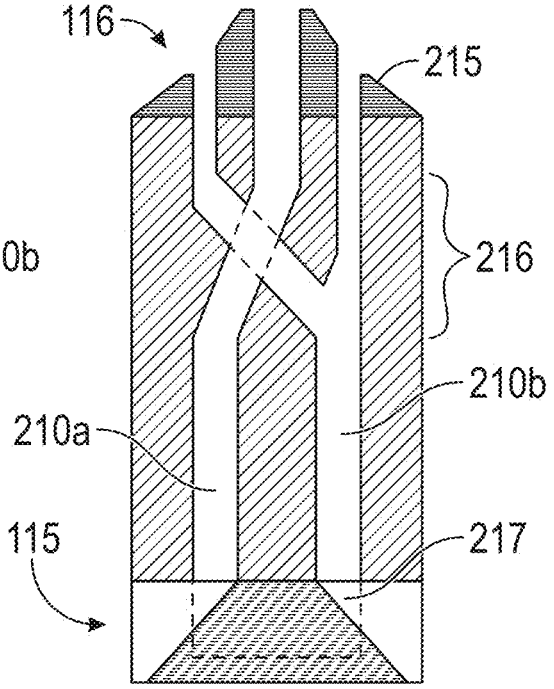

In other embodiments, the bidirectional fluid conduit (201) may include two pipes, a first pipe (210*a*) and a second pipe (210*b*), of substantially equal cross-sectional areas running substantially parallel to each other side-by-side and embedded within a thermally insulating material (212) that in turn fills an exterior tubular (214), as shown in FIG. 2C. Each HVT (114) having bidirectional conduits are coupled, using the fastening component (118), together at each connection joint (117) as they are deployed in the wellbore until they reach the desired length that may be several thousand feet in total. For example, to allow each HVT to be coupled together, each proximal end (116) may include a first portion (215) of the fastening component (118) such as a "male" screw thread, as shown in FIG. 2D, and each distal end (115) may include a second portion (217) of the fastening component (118) such as a corresponding "female" socket at the opposing end. Each HVT may also include a cross-over section (216) at each end that transforms a side-by-side design to an annular form to facilitate the connection of the first pipe (210*a*) in one of the plurality of HVT (114) (e.g., the first HVT (131)) to the first pipe in another HVT of the plurality of HVT (114) (e.g., the second HVT (132)), and the second pipe (210*b*) in the first HVT (131) to the second pipe in the second HVT (132). In such embodiments that include the HVT, a STIR is utilized, such as the STIR (300) as described in relation to FIG. 3 to couple each HVT (114). In other embodiments, the fastening component (118) may include the first portion (215) of the fastening component (118) having a "male" compression fitting, and the second portion (217) of the fastening component (118) having a corresponding "female" compression fitting. In some embodiments, the STIR (300) may include a pump, such as the uphole pump (110), configured to pump a fluid, such as water, into each pipe in each HVT (114), for example, the first pipe (210*a*) and the second pipe (210*b*), while inserting the tubing string (119) to decrease buoyancy and facilitate insertion of the tubing string (119).

Figure 3:
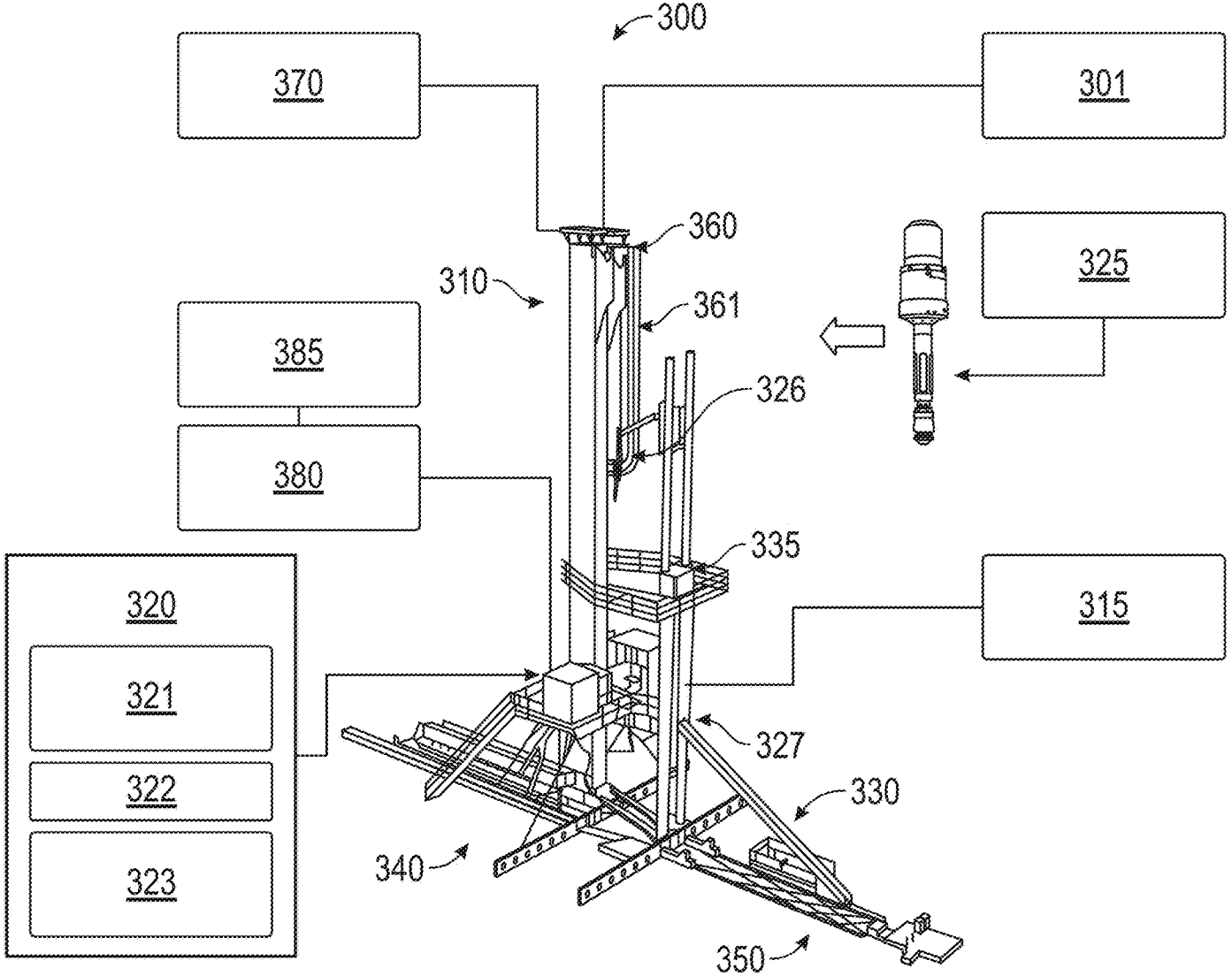
FIG. 3 depicts an oblique view of a specialized tubing insertion rig in accordance with one or more embodiments.

In accordance with one or more embodiments, FIG. 3 illustrates the specialized tubing insertion rig ("STIR") (300) according to embodiments herein that may be used to install the specialized tubing used for forming the heat exchange system (100) described above. The STIR (300) is configured to insert the plurality of HVT (114), such as vacuum-insulated tubulars, into a wellbore such as, for example, the wellbore (102) as shown and described in FIG. 1. The STIR (300) may be equipped with a hoisting system which can raise or lower the tubing string (119). The hoisting system includes a handling mast (310) having a winch (360) that is configured to raise and lower the plurality of HVT (114), and a tubular running tool (325) configured to capture each of the HVT (114) and/or tubing string (119). The tubular running tool (325) is operatively connected to the winch (360). The tubular running tool (325) may include various tool dies depending on the type and handling specifications for the plurality of HVT (114). The tool dies are configured to removably couple to each individual HVT while handling each individual HVT. The handling mast (310) is a vertical structure configured to handle a substantial amount of weight to insert tubing into a wellbore, such as the wellbore (102). The winch (360) is configured to move the tubular running tool (325) up and down by a winch motor (not shown) and cables (361) configured to maneuver the tubular running tool (325). The STIR (300) includes a control system (320) to monitor and control the maneuvering of the plurality of HVT (114) and coupling of each HVT (114). In some embodiments, the tubular running tool (325) may include internal gripping (e.g., a bladder). The tubular running tool (325) may inflate the bladder inside the HVT, trapping the HVT between the bladder on an inside surface of the HVT and tool dies on the outside surface of the HVT. Based on the disclosure herein, the tubular running tool (325) may be a free-rotating hook (not shown), a casing running tool, and the like and known to those skilled in the art. The example tubular running tool (325) as shown in FIG. 3 should not be considered limiting to the scope of the invention.

In some embodiments, the STIR (300) includes a tubing loader (330) and a tubular source stack (350). The tubing loader (330) is configured to load tubulars from the tubular source stack (350) into the hoisting system such as the handling mast (310) and the tubular running tool (325). The tubular source stack (350) may include storage racks for storing the plurality of HVT (114). In some embodiments, the tubing loader (330) may include a loading catwalk (430) as described in relation to FIG. 4A-4B.

In some embodiments, the plurality of HVT (114) may be loaded into the tubing loader (330) from the tubular source stack (350) using hydraulic lifts and/or hoists configured to maneuver the plurality of HVT (114). The plurality of HVT (114) may be loaded into the hoisting system from the tubular source stack (350) using conveyor systems that may include conveyor belts, rollers, hydraulic lifts, and the like. The hoisting system is configured to capture each HVT (114) from the tubing loader (330) using an HVT holder (335). The HVT holder (335) may be configured to move up and down to raise each HVT (114) into the hoisting system and then lower to capture the next one of the plurality of HVT (114).

In accordance with one or more embodiments, the STIR (300) is designed to handle each HVT (114) so as not to damage the outer portion (205) of each HVT (114). Each HVT (114) requires gentler handling than conventional rigs are designed for in order to avoid damage. This may be accomplished by incorporating handling hardware/software that includes a higher degree of precision in handling of tubing compared to conventional rigs. The handling hardware may include padding and rubber bumpers to soften the impact of maneuvering the plurality of HVT (114) by the various systems disclosed herein. The handling hardware may include precision motors and servos within the STIR equipment configured to handle the plurality of HVT (114) in a gentler manner relative to conventional rigs. The STIR (300) requires less equipment than conventional rigs such as, for example, the STIR (300) does not include a drilling mud system. Drilling mud systems on conventional rigs include, but are not limited to, mud pumps, mud pits, pipes, and gauges configured to deliver mud to the well for drilling and completion operations such as inserting typical steel completion tubing.

In accordance with one or more embodiments, the STIR (300) may include a tubing connection system (315). The tubing connection system (315) is configured to couple each of the plurality of HVT (114) to the previously disposed HVT in a wellbore such as the wellbore (102). The tubing connection system is configured to gently handle each HVT (114) so as not to damage the outer portion (205). In some embodiments, the tubing connection system may be configured to "screw" each HVT (114) to the previously disposed HVT in the wellbore by rotating each HVT so as to couple, using the fastening component (118), each HVT (114) to the previously disposed HVT in the wellbore. In some embodiments, the tubing connection system (315) may be configured to compress each HVT (114) into the previously disposed HVT in the wellbore.

With respect to control systems, the control system (320) may include rig hardware/software for gently handling each HVT (114). Rig hardware equipment may include, but is not limited to, cable, wire, operator controls, one or more gauges, one or more sensors for monitoring the tubing insertion operations, and the like configured for handling each HVT (114) and operatively connected to perform a tubing insertion operation with greater precision relative to conventional rigs. In some embodiments, the control system (320) may include an operator cab for a user to input commands and communication for monitoring and controlling tubing insertion operations. In some embodiments, the control system (320) may include a computer system having one or more microprocessors, and a computer memory drive for storing the rig software and instructions for controlling tubing insertion operations. In some embodiments, the STIR (300) is configured to carry out tubing insertion operations automatically using a computer system. The computer system may include a user interface for user inputs (e.g., thresholds, precision parameters, and/or rotation parameters) required for completing tubing insertion operations.

The STIR (300) may include automation hardware/software for monitoring and controlling the automation of the STIR (300) such as a computer system having one or more microprocessors, and/or a computer memory drive to store the automation software. The computer system may be operatively connected to the various components and systems of the STIR (300). The computer system may be included in the control system (320) or separately and operatively connected to the control system (320).

The STIR (300) may be disposed at and communicate with other systems in the wellbore environment, such as the well tubing planning system (385) and the control system (320). The well tubing planning system (385) is configured to develop the well tubing plan (380) based on various production parameters of the geothermal system (180) and the heat exchange system (100). The production parameters may include, but not limited to, source formation temperature, the one or more heat exchanger specifications, and heat exchanging fluid parameters. The STIR (300) may control at least a portion of a tubing insertion operation by providing controls to various components of the tubing insertion system (10). In one or more embodiments, the STIR (300) may receive data from the one or more sensors arranged to measure controllable parameters of the tubing insertion operation. As a non-limiting example, sensors may be arranged to measure cumulative weight of the tubing string (119) and downhole heat exchanger (113), downhole pressure, number of rotations of each HVT (114), rate of tubing insertion, and a "make-up" torque (hereafter "torque") of each connection joint (117). Each sensor may be positioned or configured to measure a desired physical stimulus, for example, to measure the torque on each connection joint (117) between the first portion (215) and the second portion (217) of the fastening component (118). The tubing insertion operation may be considered complete when the downhole heat exchanger (113) reaches a production target within a geothermal heat source such as, for example, the heat source (104) as shown in relation to FIG. 1.

In some embodiments, the STIR (300) may include a hydraulic system (370) configured to supply and control a hydraulic fluid for operating the various hydraulic elements of the tubing insertion system (10) such as the tubing loader (330), the winch (360), and the like. The hydraulic system (370) includes hydraulic hardware for performing hydraulic operations. Hydraulic hardware equipment may include pipes, hoses, pipe and hose fittings, gauges, sensors for monitoring hydraulic operations. Each hydraulic hardware equipment is operatively connected to perform hydraulic operations as would be apparent to a person having ordinary skill in the art.

In some embodiments, the STIR (300) includes a support system for positioning the STIR (300) at a well site and for supporting the various systems and components of the STIR (300). In some embodiments, the support system includes an adjustable folding base (340) configured to support the STIR (300) and the tubing insertion operations. The adjustable folding base (340) may be adjusted to fit the needs of the tubing insertion operations and the weight and stability of the STIR (300).

Figure 4A:
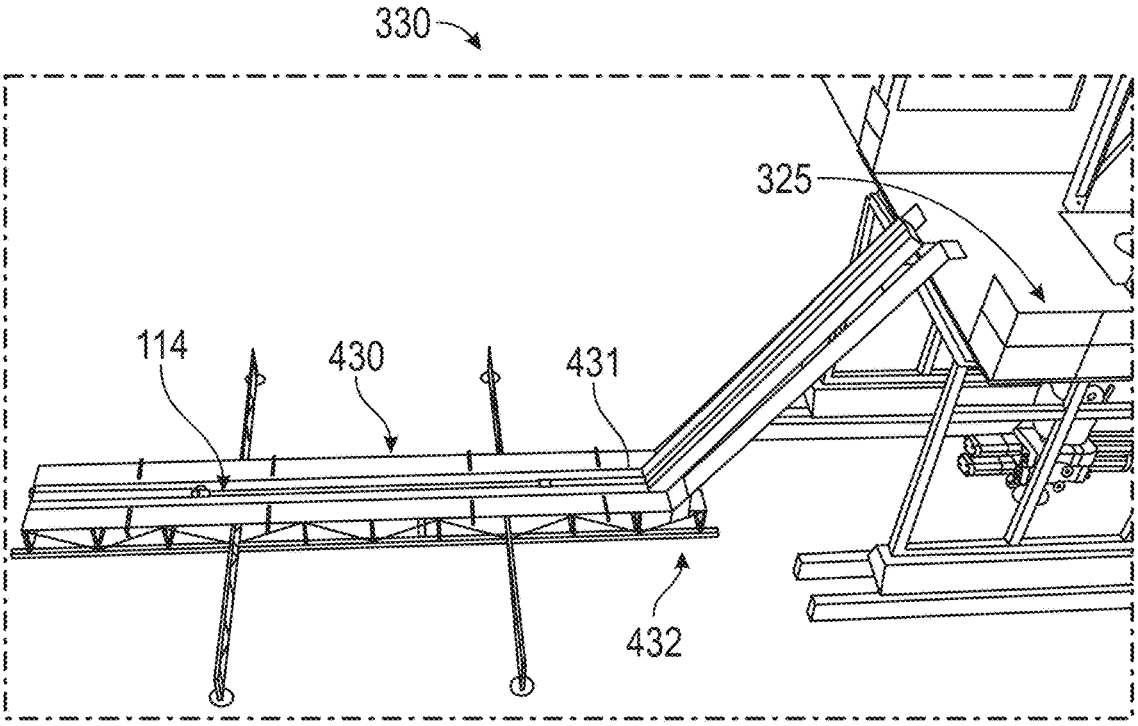
FIG. 4A-4B depicts a tubing loader in accordance with one or more embodiments.
Figure 4B:
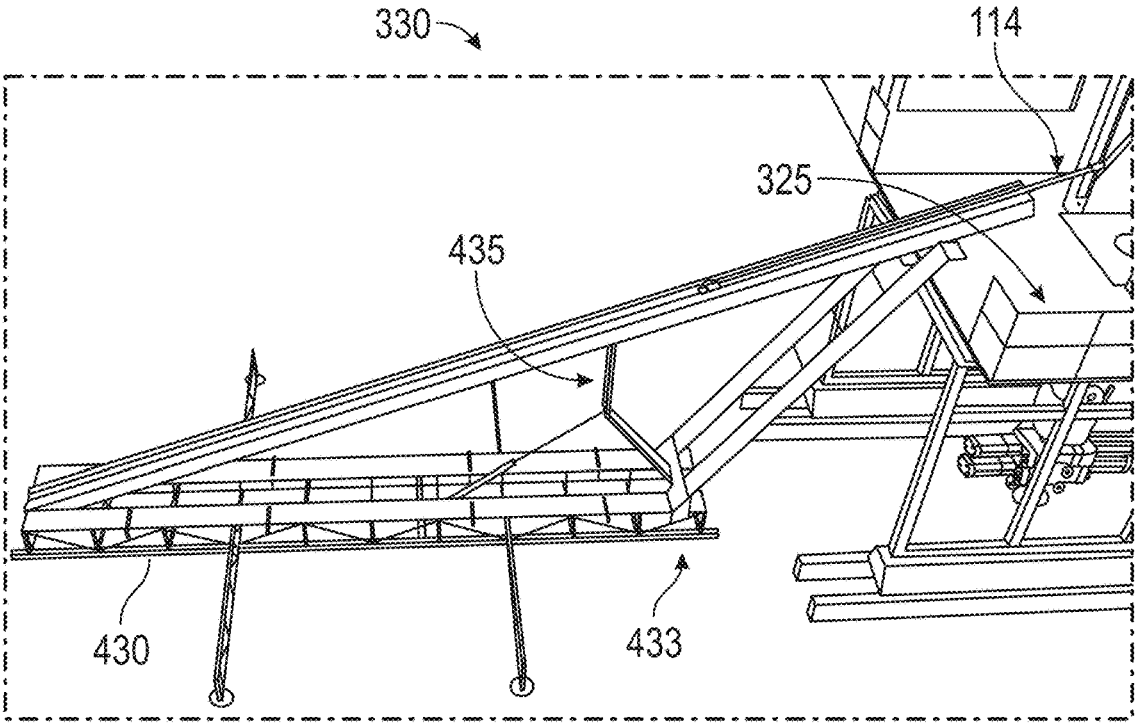

FIG. 4A-4B depicts elements of the tubing loader (330) in different configurations in accordance with one or more embodiments. The tubing loader (330) includes a loading catwalk (430) configured to receive the plurality of HVT (114) from the tubular source stack (350) in a loading configuration (432) as shown in FIG. 4A. The loading catwalk (430) includes a hinge joint (431) to facilitate the raising and lowering of the loading catwalk (430). The loading catwalk (430) is further configured to unload each HVT (114) to the hoisting system in an unloading configuration (433) as shown in FIG. 4B. The loading catwalk (430) may include an automated support arm (435) configured to facilitate the raising and lowering of the loading catwalk (430) by a hydraulic ram operatively connected to the hydraulic system (370). The loading catwalk (430) is configured to maneuver each HVT (114) toward the mast floor (327). The HVT holder (335) is configured to catch hold of the HVT (114) within the loading catwalk (430) to raise and dispose each HVT (114) into the hoisting system.

Figure 5:
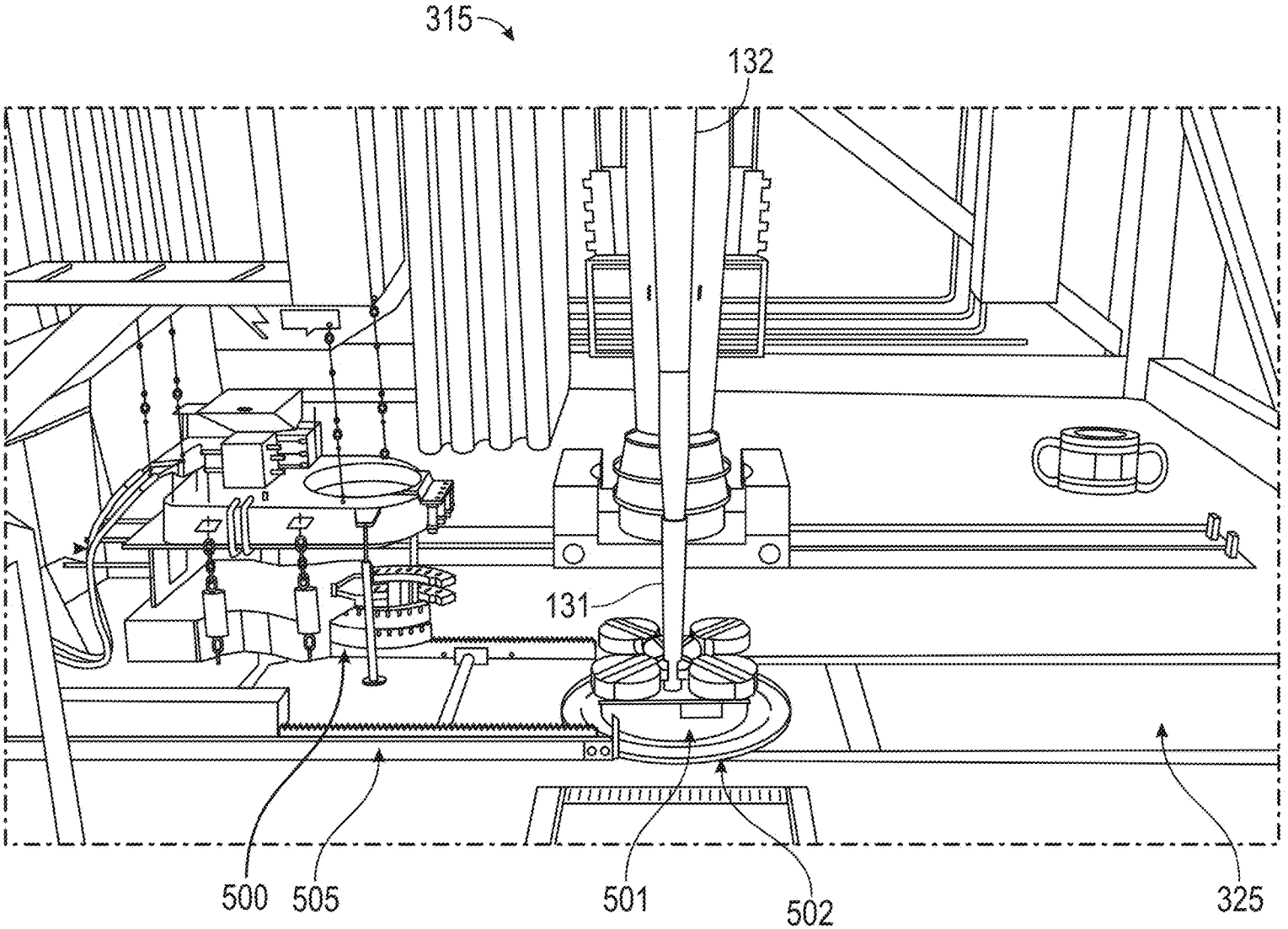
FIG. 5 shows a mast floor with various components of a tubing insertion system in accordance with one or more embodiments.

FIG. 5 depicts the tubing connection system (315) configured to couple each of the plurality of HVT (114). The tubing connection system (315) may include a spider device (501) and a connection device (500), such as a power tong, in accordance with one or more embodiments. The spider device (501) is configured to grasp one of the plurality of HVT (114) (e.g., the first HVT (131)) in order to couple to another one of the plurality of HVT (114) (e.g., the second HVT (132). The spider device (501) may include a plurality of jaws configured to maneuver to compress against each HVT (114) in order to grasp each HVT (114). The spider device (501) is disposed on the mast floor (327) removably coupled to a floor hole (502) in the mast floor (327) and is configured to allow one of the plurality of HVT (114) (e.g., the first HVT (131) and/or the second HVT (132)) to pass through, at least partially, the floor hole (502) in the mast floor (327). For example, the spider device (501) may grasp the first HVT (131) so that the first HVT (131) is suspended at least partially within the well by the spider device (501) so that the proximal end (116) of the first HVT (131) is adjacent to the mast floor (327). The tubing connection system (315) may include a connection device track (505). The connection device (500) may be disposed on the connection device track (505). The connection device track (505) may be configured to facilitate the maneuvering of the connection device (500) to couple each of the HVT together. Each component is configured for the appropriate diameter of the HVT. The connection device (500), the spider device (501), and/or the tubular running tool (325) are configured to handle each HVT according to the tubular handling specifications such as a tubular outer diameter, tubular weight (sometimes known as "vertical load"), and/or material handling specification to prevent damage to each HVT. For example, the tubular running tool (325) may be adapted to larger or smaller pipe sizes and may have either an internal or external gripping system, depending on the pipe size and weight. Tubular handling specifications may select harder and more brittle dies for standard piping, or softer metallurgy in the dies for chrome alloy pipes.

In some embodiments, the connection device (500), such as the power tong, is configured to grasp one of the plurality of HVT (114) (e.g., the second HVT (132)), align each corresponding end of the plurality of HVT (114) (e.g., the first HVT (131) and the second HVT (132)) and are configured to couple the HVT (114) held by the hoisting system (e.g., the second HVT (132)) with of the HVT (114) being grasped by the spider device (501) (e.g., the first HVT (131)). In some embodiments, the STIR (300) may include an alignment guide (326) configured to align each HVT (114). For example, the alignment guide (326) may include a pipe stabbing guide configured to guide the proximal end (116) of the first HVT (131) and each distal end (115) of the second HVT (132) so that the distal end (115) of the second HVT (132) may be "stabbed" correctly into the proximal end (116) of the first HVT (131)) before rotating the second HVT (132) for coupling.

In one or more embodiments where the fastening component (118) includes male and female threaded portions, the connection device (500), such as the power tong, may be configured to rotate one of the plurality of HVT (114) so as to "screw" each male threaded portion to each female threaded portion together thereby coupling each of the plurality of HVT (114) to a preset torque threshold (323).

In accordance with one or more embodiments, the control system (320) may be configured to determine a number of rotations (321) of the proximal end (116) of the each HVT (114) (e.g., the second HVT (132)) during coupling of each HVT (114) (e.g., coupling of the first HVT (131) and the second HVT (132)). The control system (320) may be configured to determine if a torque (322) experienced between the proximal end (116) of each HVT (e.g., the first HVT (131)) and the distal end (115) of another HVT (e.g., the second HVT (132)) is greater than the preset torque threshold (323). The preset torque threshold (323) may be input, using a user interface, by a user. The control system (320) may be configured to control and monitor running speeds and connection processes. The control system (320) may be configured to control and monitor running speeds, the torque (322) experienced, and the number of rotations (321) of each HVT (114) automatically.

In some embodiments, the control system (320) is configured to control and monitor vertical loads. The vertical load is controlled and monitored to apply constant and feed rate of each tubular as the tubular is fed into coupling of each HVT (114) to avoid high-impact connections that may damage the tubulars.

In some embodiments, the STIR (300) may be configured to handle each HVT (114) automatically so as to reduce risk of damaging, such as "cross-threading", each threaded portion during connection operations. The STIR (300) may be configured to handle each HVT (114) with greater precision than conventional rigs to avoid damaging the connection portions of each HVT (114). The connection device (500) may be communicably coupled to the control system (320). The number of rotations (321) and the torque (322) experienced may be communicated from the connection device (500) to the control system (320).

For an example embodiment, Table 1 shows a comparison of a STIR set-up and operation parameters as compared to a convention drilling and service rigs. In some embodiments, the STIR (300) may include fewer operating systems than a conventional drilling rig, such as drilling mud systems. Since the STIR (300) includes less systems, the STIR (300) includes a power supply configured to use either electrical power to drive the systems distributed from a local power station, not typically done with conventional rigs, or a local generator that uses diesel similar to conventional rigs. In some embodiments, the STIR (300) is configured to be set-up at a well site in less time than a conventional rig. The STIR (300) is configured to require less persons in an operating crew than a conventional rig. The STIR (300) is configured to install HVT at a substantially increased rate of feet/hour compared to conventional rigs and so will spend less time at a well site. The STIR (300) is configured to gently handle HVT such as VIT so the HVT will incur less damage. Based on the disclosure herein, handle gently may include handling of each HVT so that the plurality of HVT (114) at any point does not experience forces that will adversely affect the function of the HVT. Adverse effects may include bending of the HVT while capturing and loading the HVT into the handling mast, improper connections such as cross-threading, uncertain feed rate and vertical loading leading to thread damage and improper "stabbing" operations where force of contact between the HVT may cause damage to the HVT leading to connection leaks.

| Attribute | STIR (invention) Rig | Conventional Drilling Rig | Conventional Service Rig |
|---|---|---|---|
| Power supply on most rigs | Electric or diesel | Diesel | Diesel |
| Setup/removal time, days | 1 | 3 | 2 |
| Operating crew per 12-hour shift | 3 | 6 | 4-6 |
| Tubing installation rate, feet/hour | 380 | 190 | 250 |
| Typical days on well | 4-5 | 14-16 | 10-13 |
| Damage rate to VIT | <5% | 15-30% | 10-20% |
| Rotary drilling tools | Unnecessary | Present | Usually present |
| Automated tool handling | Yes | No | No |

Figure 6A:
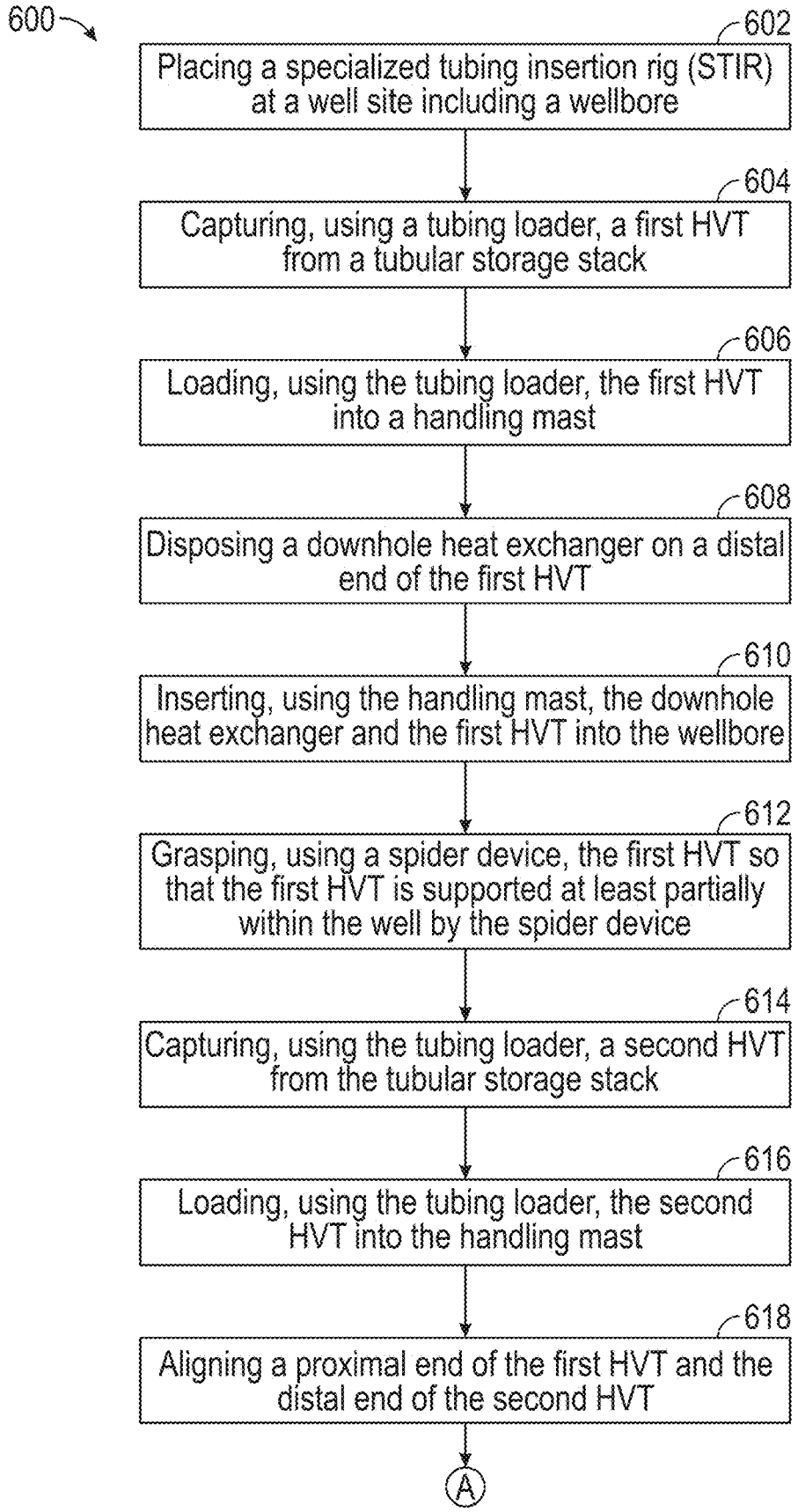
FIG. 6A-6B depicts a flowchart depicting a tubing insertion method in accordance with one or more embodiments.
Figure 6B:
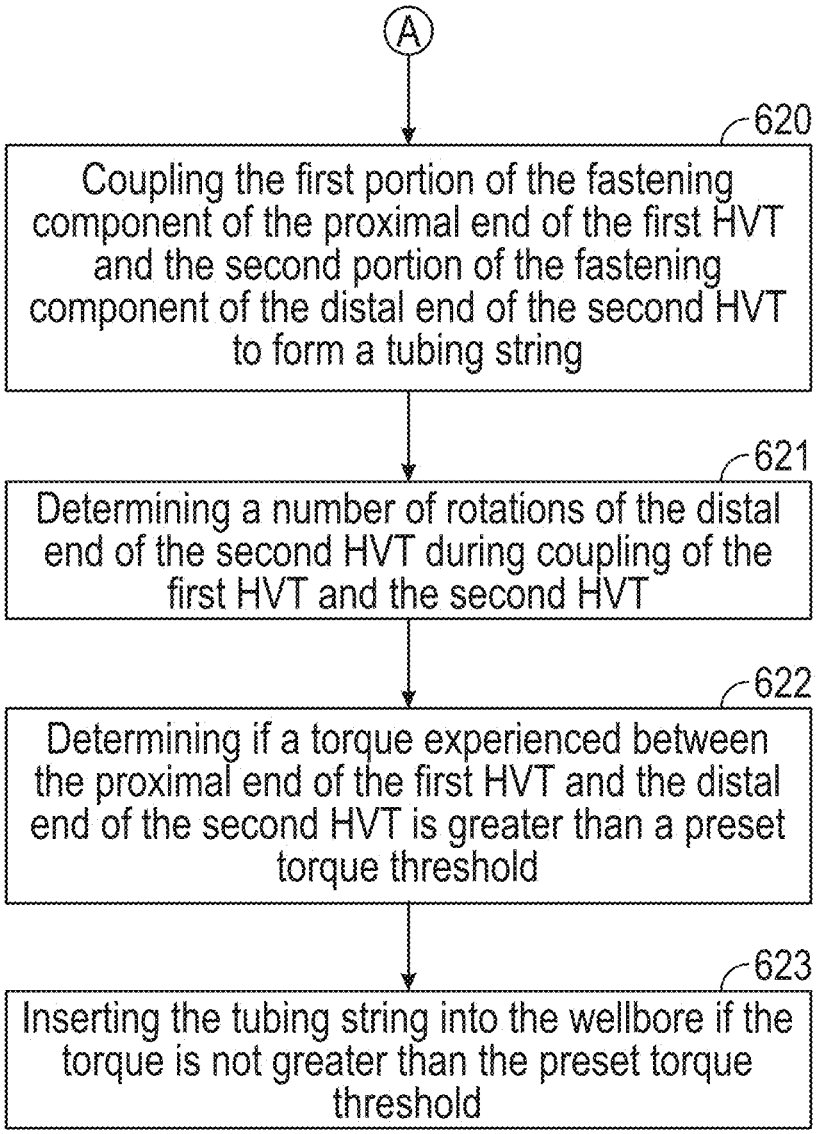

FIG. 6A-6B depicts a flowchart in accordance with one or more embodiments describing a method for installing tubulars in a wellbore penetrating a source formation (hereafter "tubing insertion method" (600)). In some embodiments, the tubing insertion method (600) may use the tubing insertion system (10). Although the steps in flowchart using the tubing insertion method (600) are shown in sequential order, it will be apparent to one of ordinary skill in the art that some steps may be conducted in parallel, in a different order than shown, or may be omitted without departing form the scope of the invention.

In box (602), the tubing insertion method (600) includes placing the STIR (300) at a well site such as well site (101) in accordance with one or more embodiments. The well site (101) may include a preexisting wellbore drilled for other reasons and now repurposed for producing geothermal energy or the wellbore is a newly drilled wellbore for producing geothermal energy. The STIR (300) is configured to insert the plurality of HVT (114) having the axial length (203) into a wellbore such as wellbore (102). The axial length (203) of each HVT (114) may be longer than typical tubulars. Producing geothermal energy may include reducing heat loss by using the plurality of HVT (114) having the axial length (203) greater than typical tubulars as the longer axial lengths will result in less connection joints. Less connection joints will reduce heat loss as most connection joints may be typical heat loss leak points.

In box (604), the tubing insertion method (600) includes capturing, using the tubing loader (330), the first HVT (131) from the tubular source stack (350) in accordance with one or more embodiments. In some embodiments, the tubing loader (330) may include the HVT holder (335) configured to capture each HVT (114). Capturing the first HVT (131) may include capturing the first HVT (131) using the HVT holder (335). The tubing insertion method may include handling gently each HVT (114) so as not to damage the outer portion (205).

In box (606), the tubing insertion method (600) includes loading, using the tubing loader (330), the first HVT (131) into the handling mast (310). In some embodiments, the HVT holder (335) is configured to load the first HVT (131) into the handling mast (310). The HVT holder (335) may include an attachment mechanism (not shown) configured to capture and load each HVT (114) into the handling mast (310).

In box (608), the tubing insertion method (600) includes disposing the downhole heat exchanger (113) on the distal end (115) of the first HVT (131). In some embodiments, the downhole heat exchanger (113) may include the first portion (215) of the fastening component (118) such as described in relation to FIG. 2D. The downhole heat exchanger (113) may be coupled to the first HVT (131) using the first portion (215) of the fastening component (118) of the downhole heat exchanger (113) and the second portion (217) of the fastening component (118) of the distal end (115) of the first HVT (131).

In box (610), the tubing insertion method (600) includes inserting, using the handling mast (310), the downhole heat exchanger (113) and the first HVT (131) into a wellbore such as wellbore (102). The first HVT (131) is inserted with the distal end (115) inserted first and the first HVT (131) is inserted until the proximal end (116) is positioned adjacent to the spider device (501) configured to grasp each of the plurality of HVT (114).

In box (612), the tubing insertion method (600) includes grasping, using the spider device (501), the first HVT (131) so that the first HVT (131) is suspended at least partially within the well by the spider device (501). The spider device (501) may be configured to gently handle each HVT (114) so as not to damage the outer portion (205) of each HVT (114).

In box (614), the tubing insertion method (600) includes capturing, using the tubing loader (330), the second HVT (132) from the tubular source stack (350). Capturing the second HVT (132) may include capturing the second HVT (132) using the HVT holder (335).

In box (616), the tubing insertion method (600) includes loading, using the tubing loader (330), the second HVT (132) into the handling mast (310). In some embodiments, the HVT holder (335) is configured to load the second HVT (132) into the handling mast (310).

In box (618), the tubing insertion method (600) includes aligning the proximal end (116) of the first HVT (131) and the distal end (115) of the second HVT (132). In some embodiments, the tubing insertion method (600) may include positioning the connection device (500) using the connection device track (505) so as to couple each of the HVT (114) together. In some embodiments, the connection device (500) is configured to align each HVT automatically.

In box (620), the tubing insertion method (600) includes coupling, using the tubing connection system (315) such as the connection device (500), the first portion (215) of the fastening component (118) of the proximal end (116) of the first HVT (131) and the second portion (217) of the fastening component (118) of the distal end (115) of the second HVT (132) to form the tubing string (119). In some embodiments, the coupling of the first HVT (131) and the second HVT (132) automatically forms the connection joint (117) that is leak-free.

In box (621), the tubing insertion method (600) includes determining, using a control system (320), the number of rotations (321) of the proximal end (116) of the each HVT (114) (e.g., the second HVT (132) during coupling of each HVT (114). The control system (320) may be configured to count each rotation (321) and record the number of rotations (321) in a computer memory drive. In some embodiments, the tubing insertion method (600) may include determining if the number of rotations (321) is less than a rotation threshold. If the number of rotations (321) is less than a rotation threshold, then it may be determined that the HVT has stopped rotating due to a bad joint and/or damage to the fastening component (118).

In box (622), the tubing insertion method (600) includes determining if the torque (322) experienced between the proximal end (116) of the first HVT (131) and the distal end (115) of the second HVT (132) is greater than the preset torque threshold (323). Determining the torque (322) experienced may include obtaining a torque reading from a sensor configured to measure torque during coupling of each HVT (114).

In some embodiments, the tubing insertion method (600) may include determining a bad joint if the number of rotations (321) is less than a rotation threshold and/or if the torque (322) experienced by proximal end (116) of the first HVT (131) and the distal end (115) of the second HVT (132) is greater than the preset torque threshold (323). If a bad joint is determined, the tubing insertion method (600) may include remediation operations such as replacing a damaged HVT or fixing any damaged fastening components.

In box (623), the tubing insertion method (600) includes inserting the tubing string (119) into a wellbore such as the wellbore (102) if the torque (322) is not greater than the preset torque threshold (323), wherein the tubing string (119) is operatively connected to the heat utilization facility (106) configured to control production of geothermal energy from the tubing string (119). In some embodiments, inserting the tubing string (119) may include inserting the tubing string (119) without circulation of wellbore fluid. In some embodiments, the STIR may include a pump, such as the uphole pump (110). Inserting the tubing string may include inserting the tubing string while pumping fluid such as water, using the uphole pump, through the tubing string.

In some embodiments, the tubing insertion method (600) may be used to insert tubulars configured to produce geothermal energy from the source formation (105) using the heat utilization facility (106) and the tubing string (119). The heat utilization facility (106) is operatively coupled to the tubing string (119).

Embodiments of the present disclosure may provide at least one of the following advantages. The use of a STIR provides savings in on-well time and costs over typical drilling and tubing insertion rigs and systems. The STIR is configured to gently handle HVT to avoid damaging the HVT, such as vacuum-insulated tubing, and associated equipment such as tubing joints, insulation, sensors, and similar equipment into a well, either during drilling or completion of the well, or as part of a well workover or reactivation process. If an HVT is damaged, the HVT will need to be replaced which results in extra cost. Handly HVT gently includes handling HVT in a fashion that minimizes or eliminates damage to the HVT while simultaneously providing better and more trustworthy connection of the HVT, thereby decreasing the costs and complexity of the process for well drillers and operators. Automation of a tubing insertion system allows for lower costs and mitigates risk to workers. Automation also decreases the risk of leaks by avoiding damage to the fastening component with greater precision while connecting each HVT. The greater precision of automation removes the risk of worker errors. The greater efficiency of the STIR provided by the rig configuration and operating procedures allows for increased pipe insertion faster, thus limiting time on well and decreasing cost per well.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A specialized tubing insertion rig (STIR) for installing a plurality of bidirectional fluid conduits (BFC) in a wellbore, the STIR comprising:

a handling mast;

a tubular source stack, configured to store the plurality of BFC; and a tubing loader, comprising a tubular running too, configured to:

capture a first BFC from the tubular source stack, load the first BFC into the handling mast, capture a second BFC from the tubular source stack, and load the second BFC into the handling mast, wherein the handling mast is configured to insert a downhole heat exchanger and the first BFC into the wellbore;

a spider device configured to grasp the first BFC so that the first BFC is suspended at least partially within the wellbore by the spider device; and a connection device configured to:

align a proximal end of the first BFC and a distal end of the second BFC; and couple a first portion of a fastening component of the proximal end of the first BFC and a second portion of the fastening component of the distal end of the second BFC to form a tubing string, wherein the STIR is configured to insert the tubing string into the wellbore; and a control system configured to:

determine a number of rotations of the proximal end of the second BFC during coupling of each BFC and detecting if the number of rotations exceeds a preset rotation threshold;

determine a torque experienced between the proximal end of the first BFC and the distal end of the second BFC and detecting if the torque is greater than a preset torque threshold.

2. The system of claim 1, wherein each of the plurality of BFC comprises an axial length that is greater than 30 ft in length, wherein the STIR is configured to insert the plurality of BFC having the axial length into the wellbore.

3. The system of claim 1, wherein the tubular running tool comprises a bladder configured to grip an internal surface of the BFC.

4. The system of claim 1, wherein the handling mast comprises:

a tubular running tool configured to capture each of the first BFC and the second BFC; and a winch configured to raise and lower the tubular running tool.

5. The system of claim 1, wherein the STIR further comprises an uphole pump, configured to pump working fluid into the BFC during insertion of the BFC into the wellbore.

6. The system of claim 1, wherein the connection device comprises a power tong configured to rotate the second BFC to couple the second BFC to the first BFC.

7. The system of claim 1, wherein the BFC comprises a vacuum-insulated tubular.

8. The system of claim 1, wherein the STIR further comprises an adjustable folding base.

9. The system of claim 1, wherein the STIR further comprises an adjustable folding base.

10. A method for installing bidirectional fluid conduits (BFC) in a wellbore penetrating a source formation, the method comprising:

placing a specialized tubing insertion rig (STIR) at a well site including the wellbore, wherein the STIR is configured to handle a plurality of BFC so as not to damage each of the plurality of BFC and insert the plurality of BFC in the wellbore, wherein the plurality of BFC comprises a first BFC and a second BFC;

capturing, using a tubular loading tool, the first BFC from a tubular source stack, wherein each of the plurality of BFC comprises a distal end and a proximal end, wherein each distal end comprises a first portion of a fastening component and each proximal end comprises a second portion of the fastening component;

loading, using the tubular loading tool, the first BFC into a handling mast;

disposing a downhole heat exchanger on the distal end of the first BFC;

inserting, using the handling mast, the downhole heat exchanger and the first BFC into the wellbore, wherein the first BFC is inserted with the distal end inserted first and is inserted until the proximal end is positioned adjacent to a spider device configured to grasp each BFC;

grasping, using the spider device, the first BFC so that the first BFC is supported at least partially within the wellbore by the spider device;

capturing, using the tubular loading tool, the second BFC from the tubular source stack, loading, using the tubular loading tool, the second BFC into the handling mast;

aligning, using a connection device, the proximal end of the first BFC and the distal end of the second BFC;

coupling, using the connection device, the first portion of the fastening component of the proximal end of the first BFC and the second portion of the fastening component of the distal end of the second BFC to form a tubing string;

using a control system:

determining a number of rotations of the proximal end of the second BFC during coupling of each BFC and detecting if the number of rotations exceeds a preset rotation threshold, and determining a torque experienced between the proximal end of the first BFC and the distal end of the second BFC and detecting if the torque is greater than a preset torque threshold; and inserting, using the handling mast, the tubing string into the wellbore if the torque is not greater than the preset torque threshold.

11. The method of claim 10, wherein the tubular running tool comprises a bladder configured to grip an internal surface of the BFC.

12. The method of claim 10, wherein the handling mast comprises:

a tubular running tool configured to capture each of the first BFC and the second BFC; and a winch configured to raise and lower the tubular running tool.

13. The method of claim 10, wherein the STIR further comprises an uphole pump, configured to pump working fluid into the BFC during insertion of the BFC into the wellbore.

14. The method of claim 10, wherein the connection device comprises a power tong configured to rotate the second BFC, wherein the method further comprises rotating, using the power tong, the second BFC in order to couple the second BFC to the first BFC.

15. The method of claim 10, wherein the BFC comprises a vacuum-insulated tubular.

16. The method of claim 10, wherein the STIR is further configured to carry out tubing insertion operations automatically using a control system.

* * * * *